US006848887B2

(12) United States Patent
Kim

(10) Patent No.: US 6,848,887 B2
(45) Date of Patent: Feb. 1, 2005

(54) TURBOFAN AND MOLD THEREOF

(75) Inventor: Seong Chun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 317 days.

(21) Appl. No.: 10/042,250

(22) Filed: Jan. 11, 2002

(65) Prior Publication Data

US 2003/0039548 A1 Feb. 27, 2003

(30) Foreign Application Priority Data

Aug. 23, 2001 (KR) ..... 2001-51080
Aug. 24, 2001 (KR) ..... 2001-51429

(51) Int. Cl.[7] ..... F04D 29/30
(52) U.S. Cl. ..... 416/186 R; 249/59
(58) Field of Search ..... 416/185, 186 R, 416/187, 188, 223 B; 249/59; 425/470

(56) References Cited

U.S. PATENT DOCUMENTS 6,558,120 B2 * 5/2003 Kim et al. ..... 416/186 R
6,679,682 B2 * 1/2004 Lee ..... 415/206

FOREIGN PATENT DOCUMENTS

GB 942648 A * 11/1963 ..... 416/186 R
JP 54-72501 A * 6/1979 ..... 416/186 R
JP 7-293494 A * 11/1995

* cited by examiner

*Primary Examiner*—Christopher Verdier
(74) *Attorney, Agent, or Firm*—Birch, Stewart, Kolasch & Birch, LLP

(57) ABSTRACT

Disclosed is a turbofan which includes a hub coupled with a rotational shaft of a driving device, a plurality of blades installed at a circumference of the hub radially, and a shroud at an opposite side to the hub so as to be coupled with a plurality of the blades wherein the blades are placed between the shroud and the hub, and wherein the hub, blades, and shroud are formed in one body and wherein the shroud comprises a first extension protruding to extend from a coupling part with a leading edge of each of the blades in an inward radial direction of the rotational shaft and a second extension extending straightly from the first extension in a direction of the rotational axis toward a side opposite to the hub.

11 Claims, 8 Drawing Sheets

TURBOFAN AND MOLD THEREOF

BACKGROUND OF THE INVENTION

1. Field of the Invention

The present invention relates to a turbofan, and more particularly, to a turbofan and a mold manufacturing the same.

2. Background of the Related Art

Generally, a turbofan is a kind of centrifugal fan sending air forcibly by a centrifugal force of air generated from revolution of an impeller thereof. The turbofan produces massive airflow so as to be suitable for a refrigerator of heavy capacity.

FIG. 1 illustrates a layout of a turbofan according to a related art, and FIG. 2 illustrates a vertical cross-sectional view of the general turbofan in FIG. 1.

Referring to FIG. 1 and FIG. 2, a turbofan 1 according to a related art includes a hub 10 having a boss 11 at a central part so as to be coupled with a rotational shaft 40 of a driving device (not shown in the drawings), a plurality of blades 20 at a circumferential part 10*a* of the hub 10, and a shroud 30 arranged at a opposite face to the hub 10 so as to be coupled with the blades in one body wherein the blades 20 are inserted between the shroud 30 and the hub 10.

An internal diameter increases toward the hub 10 in a direction of the rotational shaft 40, and has a concave shape. A cross-section of each blade 20, as shown in FIG. 1, has an airfoil figure.

The above-constructed turbofan 1 according to the related art is mainly manufacture by injection molding of synthetic resin. The blades 20 and hub 10 are formed in one body, but the shroud 30 is molded separately. Theses parts are assembled reciprocally so as to complete the turbofan 1.

When the turbofan is manufactured by the above process, the number of molding patterns increases, whereby consumes time and expense excessively. Besides, the above process needs a step of assembling separate parts, thereby extending a manufacturing time to increase the overall product cost.

In order to overcome the above disadvantages or defects, a process of manufacturing a turbofan is lately used so as to reduce the number of molding patterns and skip an auxiliary assembling step. Namely, in the latest process, a maximum outer diameter d1 of the hub 10 is reduced to a size less than a minimum inner diameter d2. And, longitudinal boundary surfaces (BSL) of upper and lower molding patterns are formed to have an inner diameter equal to the maximum outer diameter d1 so as to assemble the hub 10, blades 20, and shroud 30 in one body reciprocally.

FIG. 3 illustrates longitudinal cross-sectional views of a turbofan and a molding pattern to manufacture a turbofan, and FIG. 4 illustrates a magnified cross-sectional view of the assembly of the molding pattern in FIG. 3.

Referring to FIG. 3 and FIG. 4, a molding pattern for forming a turbofan according to a related art includes a lower molding pattern part 50 arranged to be fixed to a lower part in a direction of a rotational shaft 40 and having a molding surface inside to form a partial area of a hub 10 and blades 20 and an upper molding part 60 having a molding surface inside to form the rest area of the shroud 30 and blades 20 and providing a space to form the turbofan 1 by being assembled with the lower molding part 50.

A hub molding part 61 recessed in a direction of the rotational shaft 40 is formed at a central part of the molding surface of the upper molding pattern part 60 so as to form the hub 10. And, a boss molding part 62 is formed at a central part of the hub molding part 61 so as to mold the boss 11. Along a radial direction of the rotational shaft 40, a blade molding part 63 is formed at an external side of the boss molding part 62 so as to form the blade 20 in part. Along a direction of the rotational shaft 40, a shroud molding part 64 is formed over the blade molding part 63 so as to form an upper surface of the shroud 30.

Meanwhile, a hub molding part 51 protrudes out of the central part of the upper surface of the lower molding pattern part 50, and a boss molding part 52 is formed at a central part of the hub molding part 51. Along a radial direction of the rotational shaft 40, a blade molding part 53 is formed at an external side of the hub molding part 51 so as to mold the rest of the parts of the blades 20. And, a concave shroud molding part 54 is formed at an upper part of the blade molding part 53 so as to form a lower surface of the shroud 30.

In order to manufacture the above-constructed turbofan, when the upper molding pattern part 60 is tightly coupled with the lower molding pattern part 50, a molding space to form the turbofan constructed with the hub 10, blades 20, and shroud 30, which are built in one body, is provided inside the lower and upper molding pattern parts 50 and 60. A molten synthetic resin is then injected in the molding space for the turbofan. After the injected synthetic resin has been hardened, the upper and lower molding pattern parts 60 and 50 are separated from each other as well as the turbofan 1 is separated, the turbofan having the hub, blades 20 and shroud 30 formed in one body is manufactured.

In the turbofan according to the related art, the inner diameter of the shroud 10 increases when getting closer to the hub 10 along a direction of the rotational shaft 40 so as to guide airflow with the hub 10. Thus, a cross-section of the shroud 10 is concave. In the molding pattern for form the shape of the shroud 30, the longitudinal boundary surface BSL, at which the lower and upper molding pattern parts 50 and 60 meet each other, is formed along the direction of the rotational shaft 40, and an edge 55 is formed at a contact between the longitudinal boundary surface BSL and the shroud molding part 54 of the lower molding pattern part 50. Such a sharp edge 55, when being contacted with the upper molding pattern part 60, is damaged or distorted by a relatively small external force with ease. Hence, durability of the molding pattern is shortened so as to need a replacement frequently. Thus, the turbofan according to the related art increases cost of product.

SUMMARY OF THE INVENTION

Accordingly, the present invention is directed to a turbofan and mold manufacturing the same that substantially obviates one or more problems due to limitations and disadvantages of the related art.

An object of the present invention is to provide a turbofan and mold manufacturing the same enabling to increase durability of the mold for manufacturing a turbofan by improving the structure of the turbofan.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a turbofan according to the present invention includes a hub coupled with a rotational shaft of a driving device, a plurality of blades installed at a circumference of the hub radially, and a shroud at an opposite side to the hub so as to be coupled with a plurality of the blades wherein the blades are placed between the shroud and the hub, and wherein the hub, blades, and shroud are formed in one body and wherein the shroud comprises a first extension protruding to extend from a coupling part with a leading edge of each of the blades in an inward radial direction of the rotational shaft and a second extension extending straightly from the first extension in a direction of the rotational axis toward a side opposite to the hub.

In another aspect of the present invention, for fabricating a turbofan including a hub coupled with a rotational shaft of a driving device, a plurality of blades installed at a circumference of the hub radially, and a shroud at an opposite side to the hub so as to be coupled with a plurality of the blades wherein the blades are placed between the shroud and the hub, and wherein the hub, blades, and shroud are formed in one body and wherein the shroud comprises a first extension protruding to extend from a coupling part with a leading edge of each of the blades in an inward radial direction of the rotational shaft and a second extension extending straightly from the first extension in a direction of the rotational axis toward a side opposite to the hub, assuming that a surface where the blades are formed is an upper surface by taking the hub as a reference, a mold for fabricating the turbofan includes lower and upper mold patterns. The lower mold pattern includes a hub molding part for molding a lower surface of the hub, a blade molding part protruding upward from a circumferential end of the hub molding part in a direction of the rotational shaft so as to mold a portion of each of the blades, and a shroud molding part for molding a lower surface of the shroud having the first extension at an upper area of the blade molding part. And, the upper molding pattern includes a hub molding part detachable from the upper mold pattern for molding an upper surface of the hub, a blade molding part having a boundary surface forming a boundary with an inner side of the blade molding part of the upper mold pattern for molding a rest portion of each of the blades, and a shroud molding part for molding an upper surface of the shroud having the second extension.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE INVENTION

Reference will now be made in detail to the preferred embodiments of the present invention, examples of which are illustrated in the accompanying drawings.

Figure 1:
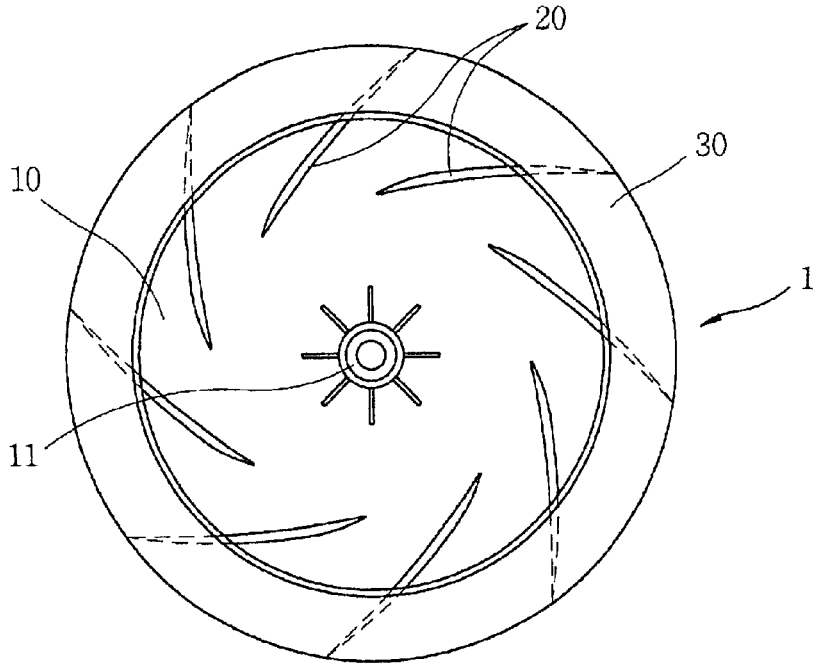
FIG. 1 CONVENTIONAL ART
FIG. 1 illustrates a layout of a turbofan according to a related art.
Figure 2:
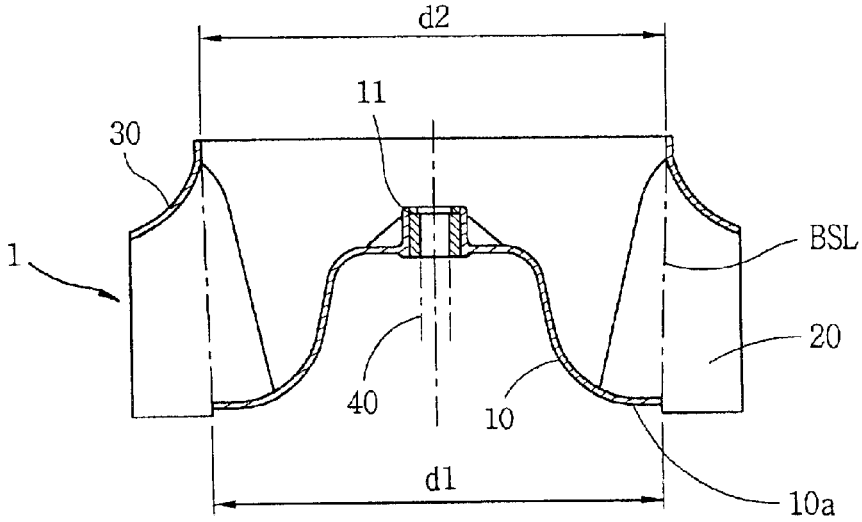
FIG. 2 CONVENTIONAL ART
FIG. 2 illustrates a vertical cross-sectional view of the general turbofan in FIG. 1.
Figure 3:
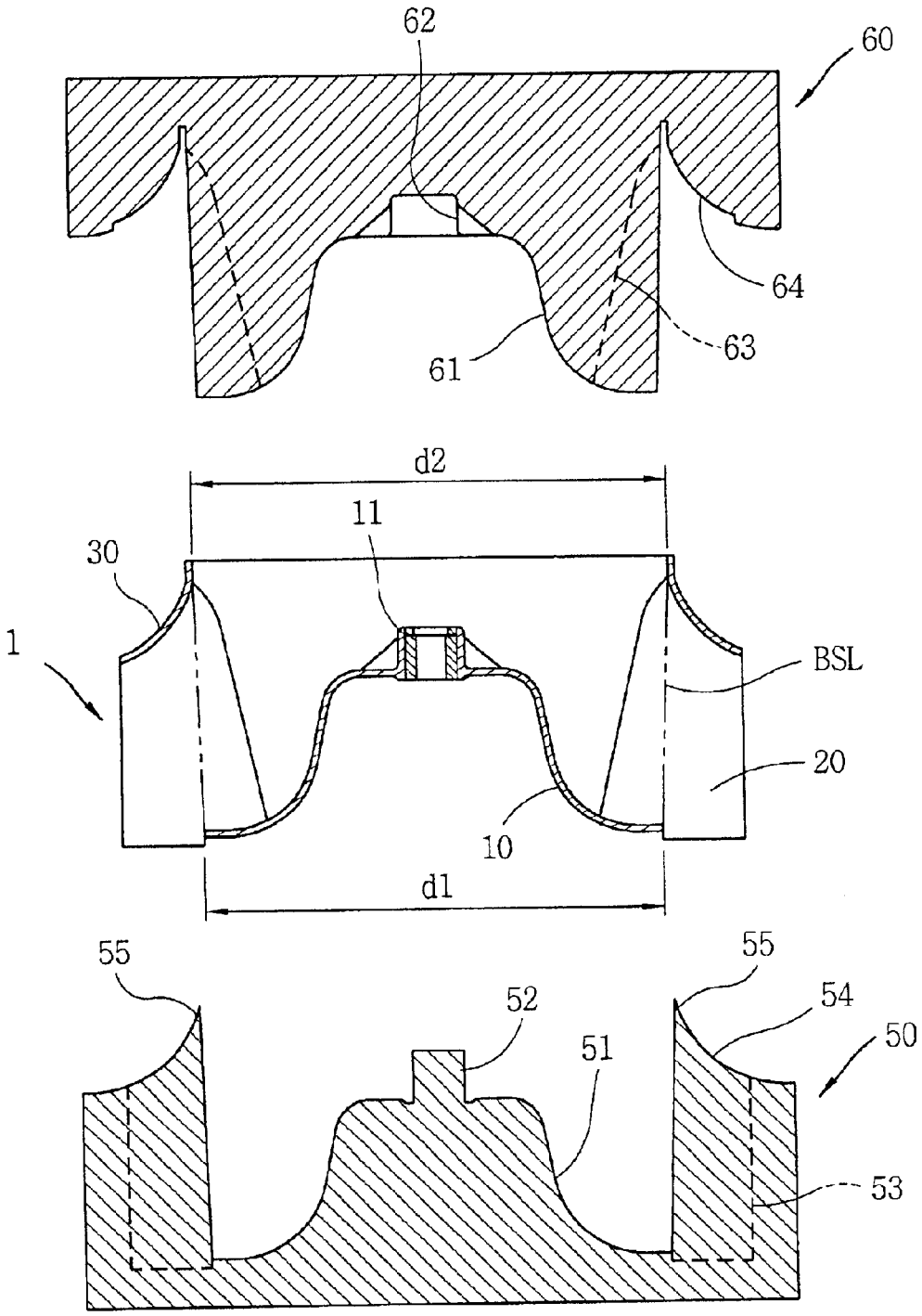
FIG. 3 CONVENTIONAL ART
FIG. 3 illustrates longitudinal cross-sectional views of a turbofan and a molding pattern to manufacture the turbofan.
Figure 4:
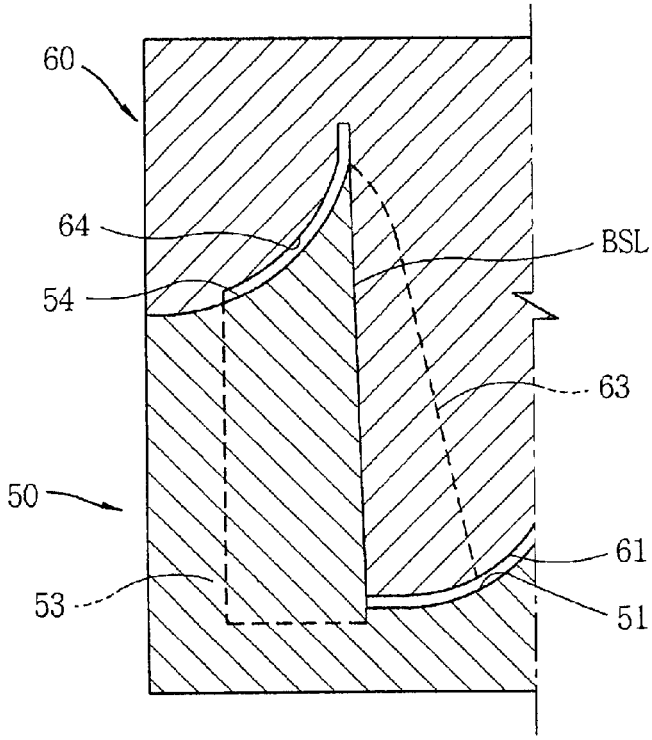
FIG. 4 CONVENTIONAL ART
FIG. 4 illustrates a magnified cross-sectional view of the assembly of the molding pattern in FIG. 3.
Figure 5:
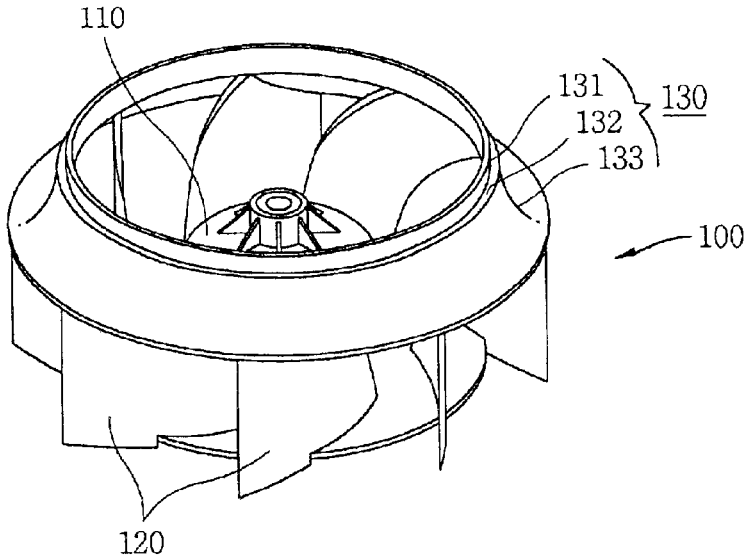
FIG. 5 illustrates a bird's-eye view of a turbofan according to a first embodiment of the present invention.
Figure 6:
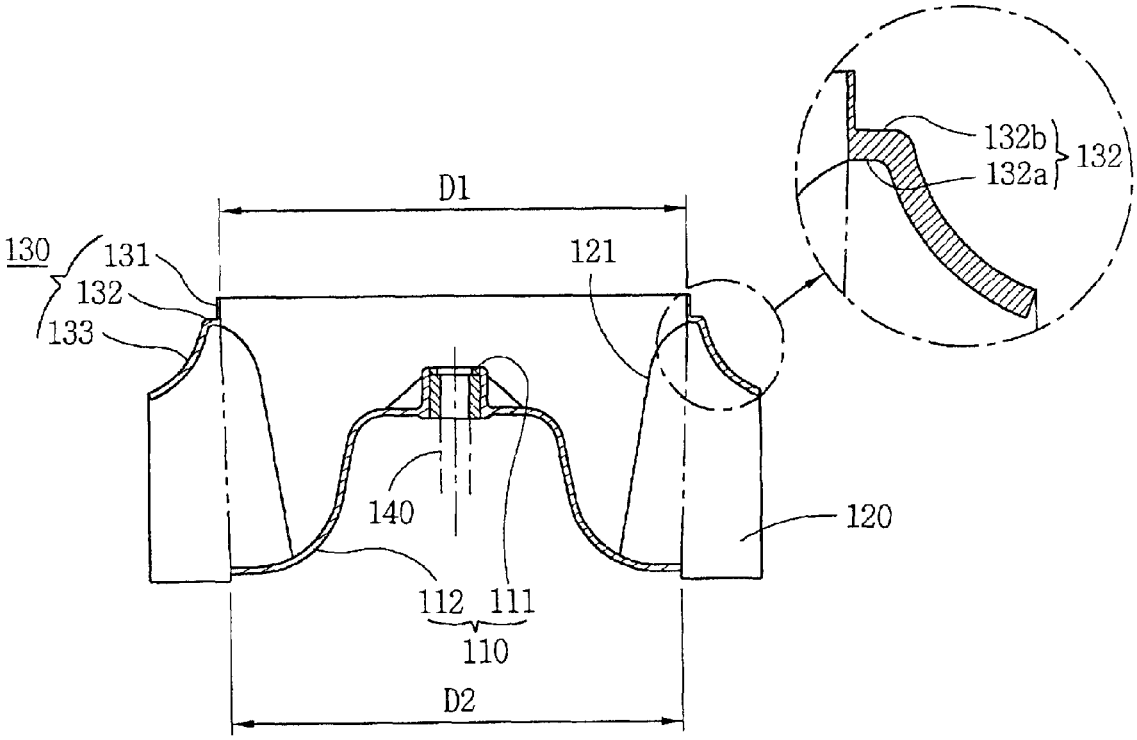
FIG. 6 illustrates a longitudinal cross-sectional view of the turbofan in FIG. 5.

FIG. 5 illustrates a bird's-eye view of a turbofan according to a first embodiment of the present invention, and FIG. 6 illustrates a longitudinal cross-sectional view of the turbofan in FIG. 5.

Referring to FIG. 5 and FIG. 6, a turbofan according to a first embodiment of the present invention includes a hub 110 having a boss 111 at a central part so as to receive to be coupled with a rotational shaft 140 of a driving device (not shown in the drawings), a shroud 130 guiding a flow of air with the hub 110, and a plurality of blades 120 arranged radially at a circumferential part of the hub 110 centering around the rotational shaft 140 so as to be coupled with the shroud 130. And, the hub 110, shroud 130, and blades 120 are built in one body.

The hub 110 includes a boss 111 protruding along a direction of the rotational shaft 140 so as to receive to be coupled with the rotational shaft 140 of the driving device (not shown in the drawings) and a circumferential part 112 extending along a radial direction of the rotational shaft 140 so as to guide the flow of air inflow with the shroud 130.

Each of the blades 120 is arranged on the circumferential part 112 of the hub 110, and a cross-section of each blade 120 has an airfoil figure.

A cross-sectional figure of the shroud 130, as shown in FIG. 6, includes a first extension 132 extending in a internal radial direction of the rotational shaft from a part connected to an inner side 121 of the blade 120, a second extension 131 of which inner diameter D1 is equal to or longer than a maximum outer diameter D2 of the hub 110 and of which inner diameter surface protrudes from the first extension 132 in parallel with the rotational shaft, and a shroud body 133 of which inner diameter increases gradually toward the hub 110 along the direction of the rotational shaft 140 from the first extension 132.

The second extension 131, as shown in FIG. 6, extends from an inner end 132*a* of the first extension 132 so as to form an 'L' figure with the first extension 132.

And, the part at which the first extension 132, as shown in the magnified portion in FIG. 6, is connected to the shroud body 133 is preferably curved concavely when being looked at from the blade 120 so as to smooth the inflow of air.

Besides, the second extension 131 of the shroud 130 may extend from an outer end of the second extension 132.

Figure 7:
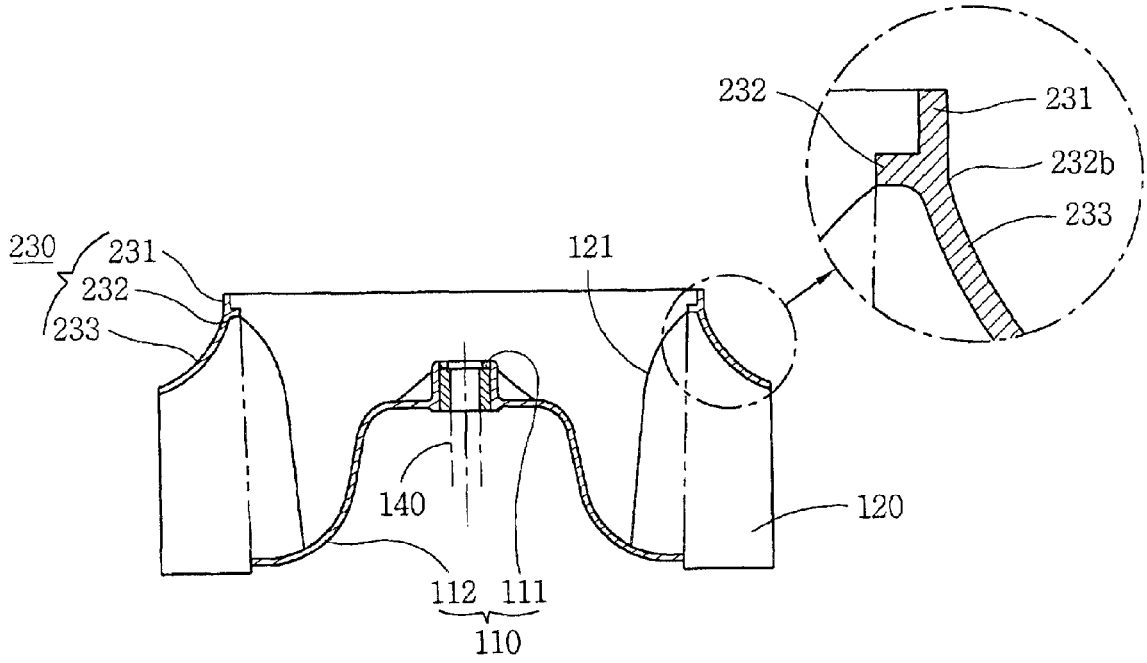
FIG. 7 illustrates a longitudinal cross-sectional view of a turbofan according to a second embodiment of the present invention.

FIG. 7 illustrates a longitudinal cross-sectional view of a turbofan according to a second embodiment of the present invention.

Referring to FIG. 7, a second extension 231 of a shroud 230 extends from an outer end 232*b* of a first extension 232 so as to form an 'L' figure, and is connected to the shroud body 233 by the same continuous surface.

Moreover, the part at which the first extension 232, as shown in the magnified portion in FIG. 7, is connected to the shroud body 233 is preferably curved concavely when being looked at from the blade 220 so as to smooth the inflow of air.

Meanwhile, the turbofan according to the first or second embodiment of the present invention may be manufactured by injection molding. A mold is required for molding injection of the turbofan, which is explained in the following description in detail.

Figure 8:
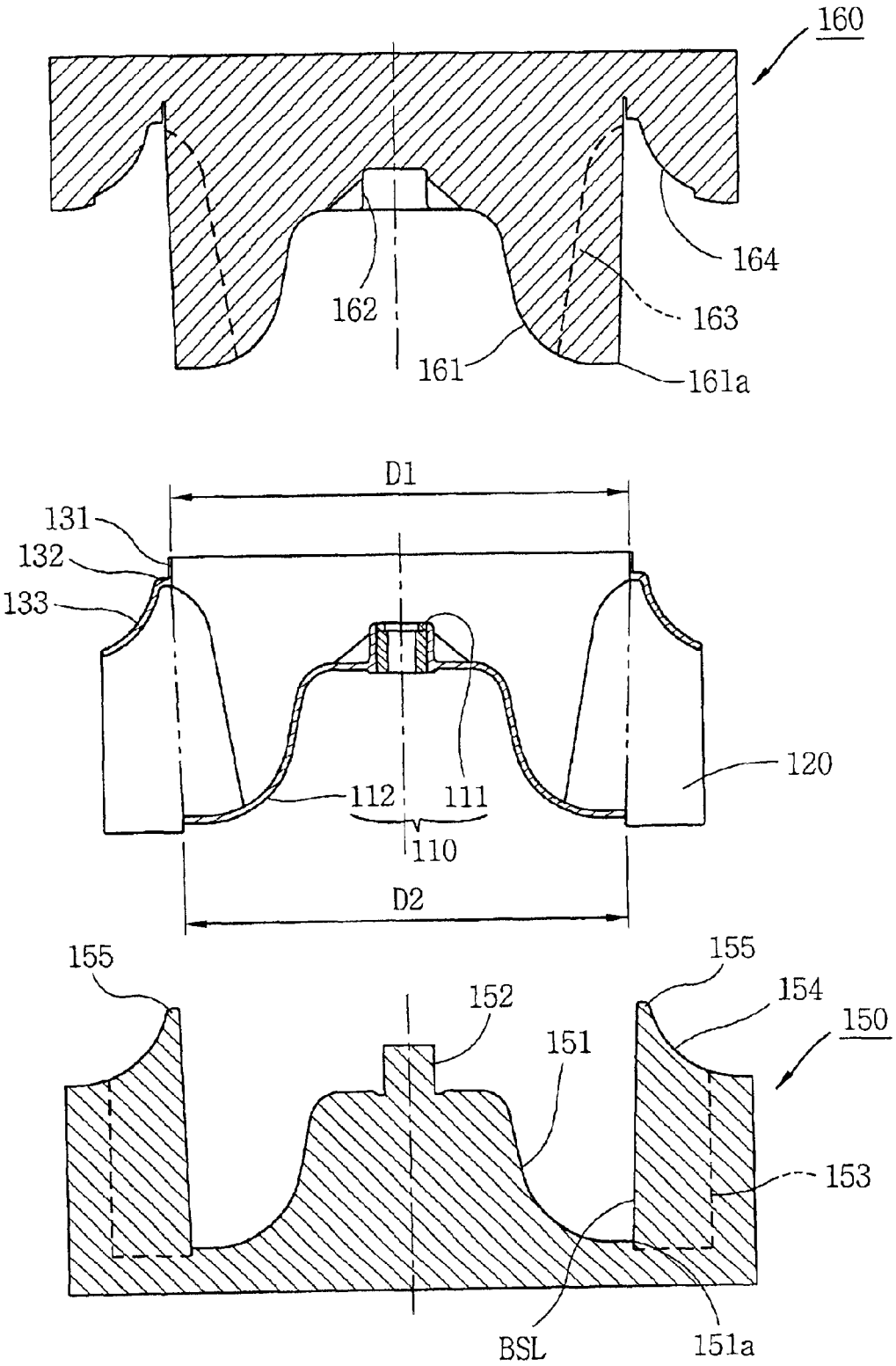
FIG. 8 illustrates longitudinal cross-sectional views of a turbofan and a mold to manufacture the turbofan according to a first embodiment of the present invention.
Figure 9:
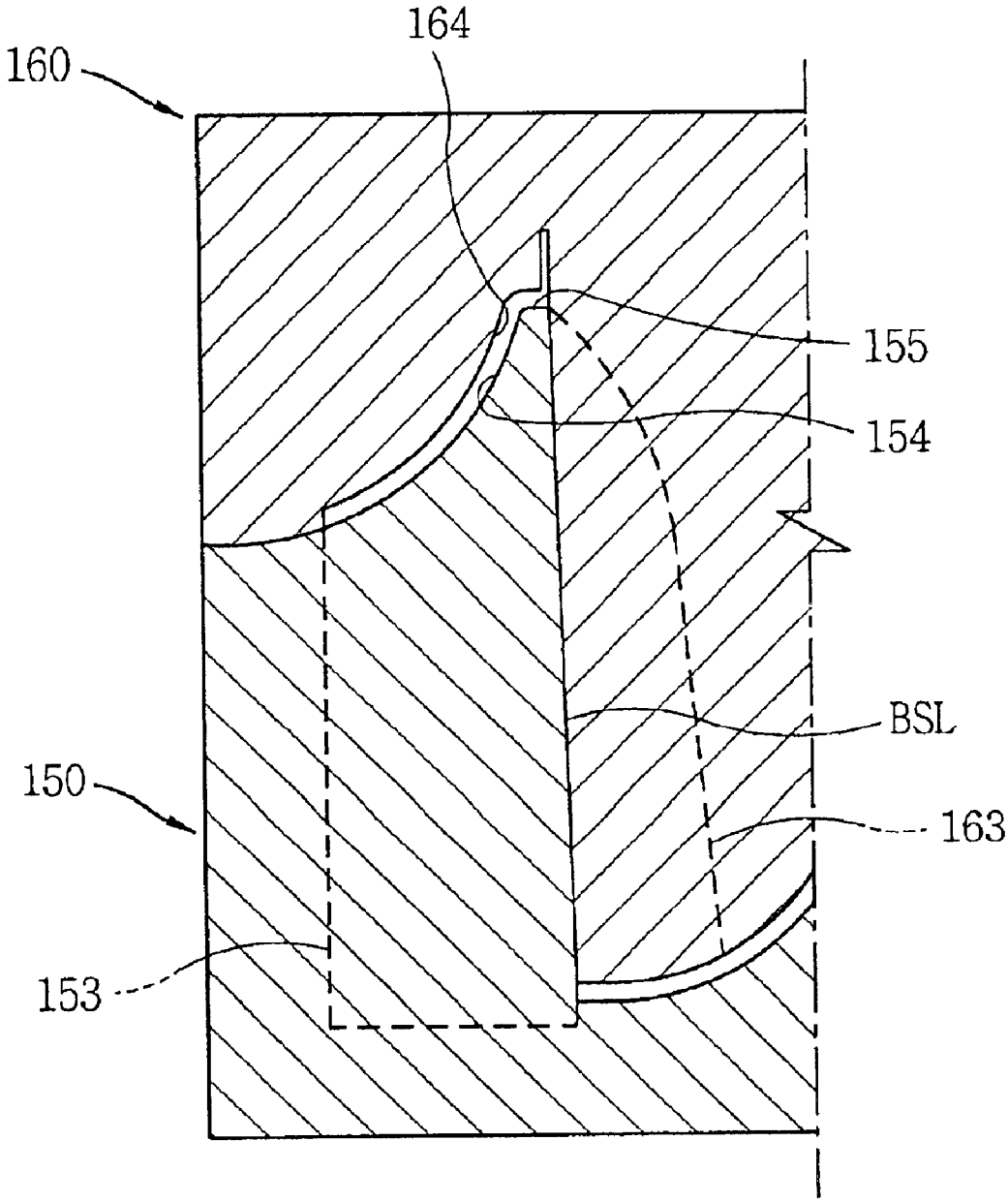
FIG. 9 illustrates a magnified cross-sectional view of the assembly of mold patterns in FIG. 8.

FIG. 8 illustrates longitudinal cross-sectional views of a turbofan and a mold to manufacture the turbofan according to a first embodiment of the present invention, and FIG. 9 illustrates a magnified cross-sectional view of the assembly of mold patterns in FIG. 8.

Figure 10:
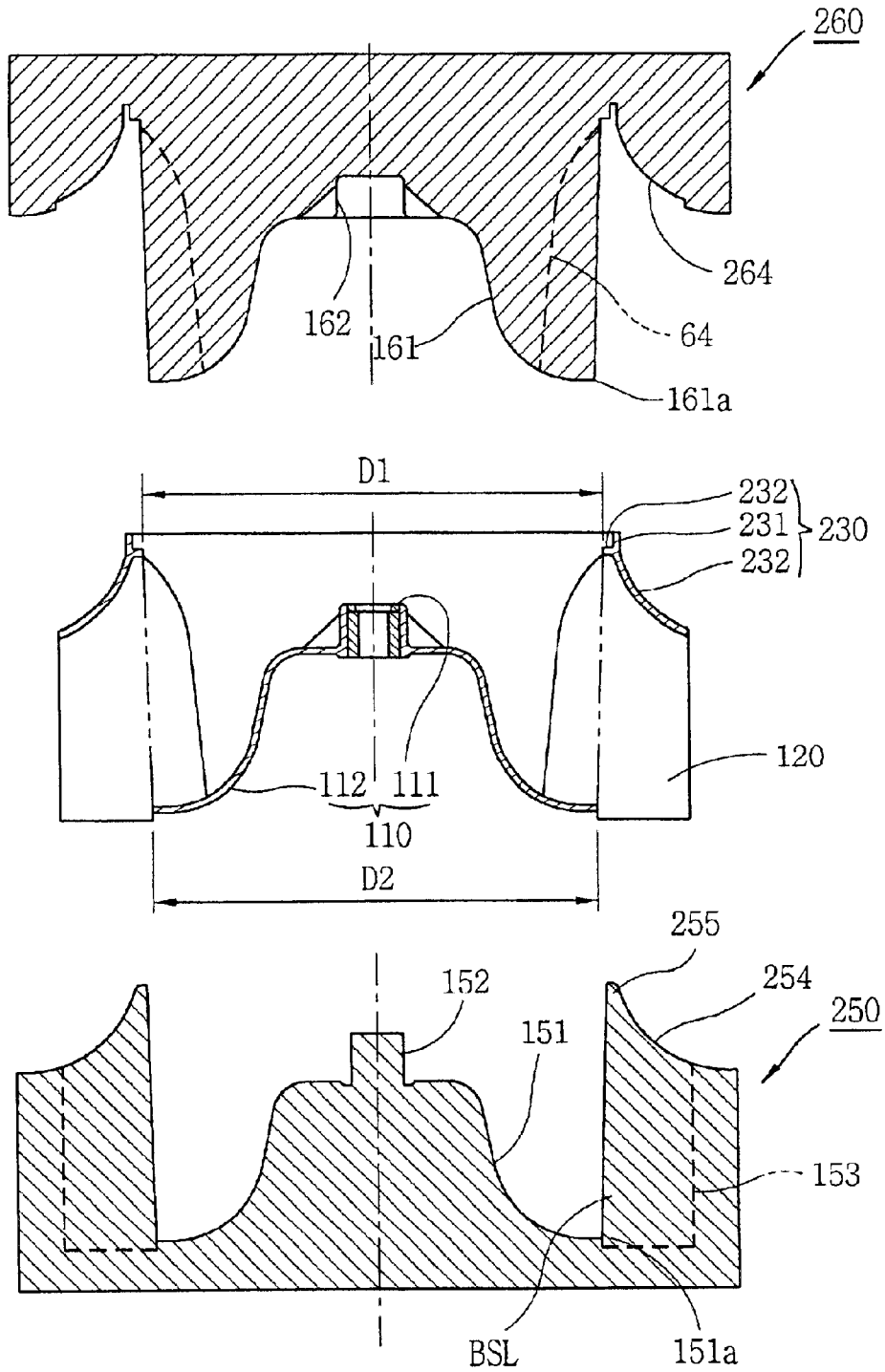
FIG. 10 illustrates longitudinal cross-sectional views of a turbofan and a mold to manufacture the turbofan according to a second embodiment of the present invention.
Figure 11:
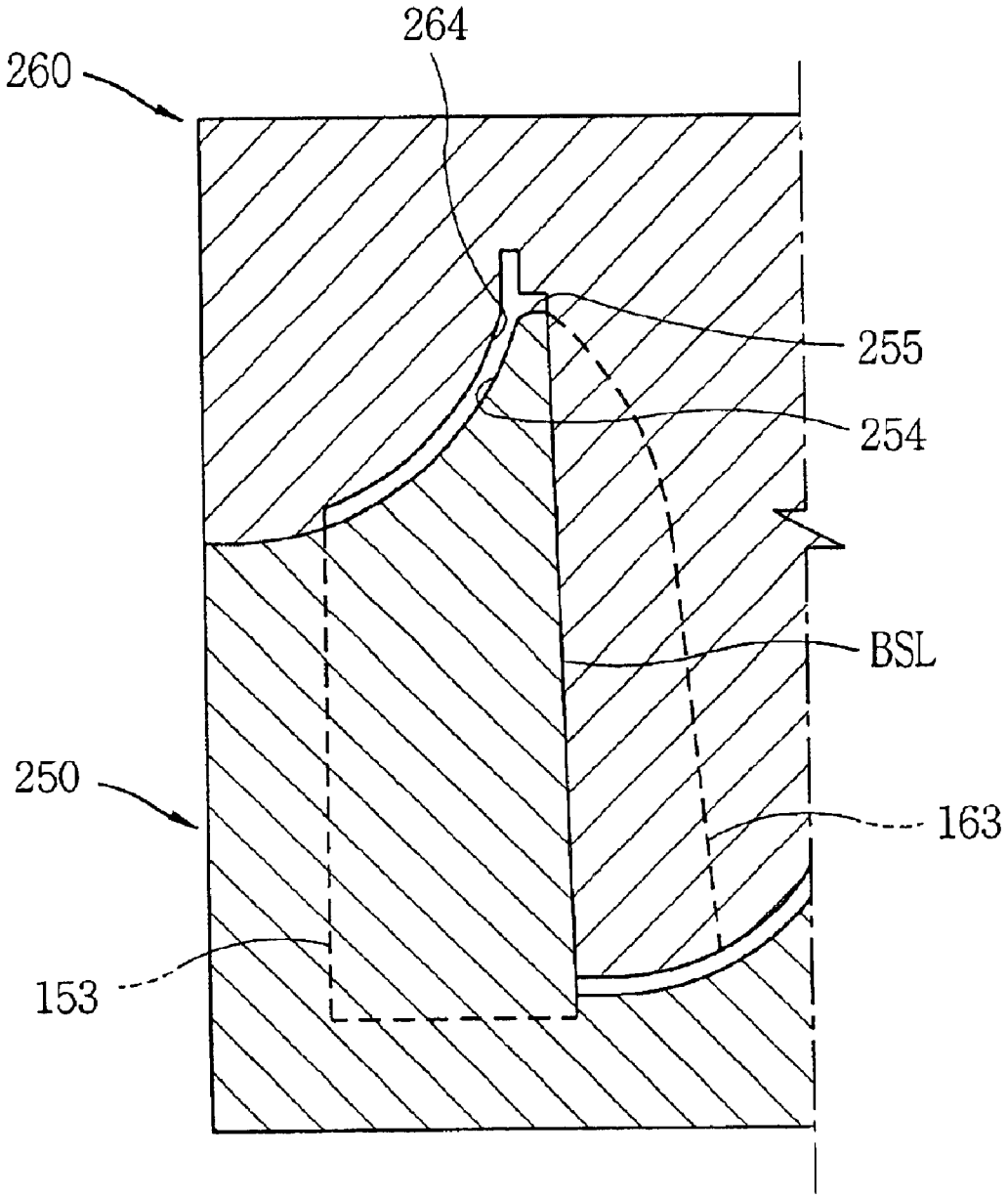
FIG. 11 illustrates a magnified cross-sectional view of the assembly of mold patterns in FIG. 10.

FIG. 10 illustrates longitudinal cross-sectional views of a turbofan and a mold to manufacture the turbofan according to a second embodiment of the present invention, and FIG. 11 illustrates a magnified cross-sectional view of the assembly of mold patterns in FIG. 10.

Referring to FIG. 8 to FIG. 11, a mold to manufacture the turbofan according to the first or second embodiment of the present invention, when being divided into an upper part having the blades 120 and a lower part by taking the hub 110 as a reference, includes an upper mold pattern 160 or 260 and a lower mold pattern 150 or 250 which form a molding space for manufacturing the turbofan by assembly.

One of the upper mold pattern 160 or 260 and the lower mold pattern 150 or 250 is arranged to be fixed to something, while the other is detachable by assembly/disassembly in a direction of the rotational shaft 140.

An upper surface of the lower mold pattern 150 or 250 has a hub molding part 151, a blade molding part 153, and a shroud molding part 154 or 254 so as to mold the hub 110, blades 120, and shroud 130 or 230 with the upper mold pattern 160 or 260, respectively.

A central part of the hub molding part 151 protrudes in the direction of the rotational shaft 140, and a boss molding part 152 protrudes from an upper area of the hub molding part 151 so as to mold an inner diameter surface of the boss 111.

The blade molding part 153 forms a portion of each of the blades 120. The blade molding part 153 protrudes upward in a direction of the rotational shaft 140 from one end 151*a* of the hub molding part 151 along a radial direction of the rotational shaft 140, and has a longitudinal boundary surface BSL having an inner diameter equal to the maximum outer diameter D2 of the hub 110.

At an upper part of the blade molding part 153, formed are a first extension molding part 155 or 255 and a shroud body molding part 154 or 254 extending in a radial direction of the rotational shaft 140 so as to mold lower surfaces of the first extension 132 or 232 and shroud body 133 or 233.

Specifically, the lower mold pattern 150 or 250, as shown in FIG. 9 or FIG. 11, has a corresponding convex part so as to make the concavely-curved surface of the connecting portion between the first extension 132 or 232 and the shroud body 133 or 233.

A lower surface of the upper mold pattern 160 or 260 has a hub molding part 161, a blade molding part 163, and a shroud molding part 164 or 264 so as to mold the hub 110, blades 120, and shroud 130 or 230 with the upper mold pattern 160 or 260, respectively.

The hub molding part 161 is recessed upward from a central part of the lower surface of the upper mold pattern 160 or 260 so as to mold the upper surface of the hub 110, and a boss molding part 162 is formed at a central area of the hub molding part 161.

At an end 161*a* of the hub molding part 161, a longitudinal boundary surface BSL having an outer diameter similar to the maximum outer diameter D2 of the hub 110 is formed so as to make a pair with the longitudinal boundary surface BSL of the blade molding part 153 in the lower mold pattern 150 or 250. And, a blade molding part 163 is formed inside the longitudinal boundary surface BSL so as to mold the rest of the blades 120.

At an upper part of the blade molding part 163 in a direction of the rotational shaft 140, as shown in FIG. 10 or FIG. 11, a shroud molding part 164 or 264 is formed to correspond to the second extension 132 or 232 in the turbofan according to the first or second embodiment of the present invention so as to mold the second extension 131 or 231, an upper surface of the first extension 132 or 232, and an upper surface of the shroud body 133 or 233.

Namely, the mold for the turbofan according to the first embodiment of the present invention, as shown in FIG. 9, forms a molding space for the second extension 131 to extend to the longitudinal boundary surface BSL of the upper mold pattern 160. Yet, the mold for the turbofan according to the second embodiment of the present invention, as shown in FIG. 11, forms a molding space for the second extension 231 outside the longitudinal boundary surface BSL of the upper mold pattern 260 so as to continue from the upper surface with the shroud body 233.

The above-constructed turbofan according to the first or second embodiment of the present invention is manufactured using the above mold(s) by the following process.

First, the lower mold pattern 150 or 250 and the upper mold pattern 160 or 260 are assembled together. A molten synthetic resin is then injected in the molding space provided by the assembly of the lower mold pattern 150 or 250 and the upper mold pattern 160 or 260. After the injected synthetic resin has been hardened, the upper and lower mold patterns 150/160 or 250/260 are separated from each other. The molded turbofan is then separated from the lower mold pattern 150 or 250.

As mentioned in the above description, the present invention improves the structure of the coupling part at which the shroud and blade insides are coupled so as to prevent the sharp edge from occurring in the mold for the turbofan fabrication.

Accordingly, the present invention elongates durability of the mold, thereby enabling to reduce cost of product.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A turbofan comprising:

a hub coupled with a rotational shaft of a driving device;

a plurality of blades installed at a circumference of the hub radially; and a shroud at an opposite side to the hub so as to be coupled with a plurality of the blades wherein the blades are placed between the shroud and the hub, and wherein the hub, blades, and shroud are formed in one body and wherein the shroud comprises a first extension protruding to extend from a coupling part with a leading edge at the uppermost portion of each of the blades in an inward radial direction of the rotational shaft and a second extension extending straightly from the first extension in a direction of the rotational axis toward a side opposite to the hub.

2. The turbofan of claim 1, wherein the second extension extends from an inward end of the first extension so as to form an 'L' figure with the first extension.

3. The turbofan of claim 2, wherein a minimum inner diameter of the shroud is equal to or longer than a maximum outer diameter of the hub.

4. The turbofan of claim 2, wherein the shroud comprises a body and having a surface, which is coupled to the blade, of a portion at which the shroud body and the first extension are connected to each other is curved.

5. The turbofan of claim 4, wherein the surface, which is coupled with the blade, of a portion at which the shroud body and first extension are connected to each other is concave.

6. The turbofan of claim 1, wherein the second extension extends from an outward end of the first extension so as to form an 'L' figure with the first extension.

7. The turbofan of claim 6, wherein a minimum inner diameter of the shroud is equal to or longer than a maximum outer diameter of the hub.

8. The turbofan of claim 6, wherein the shroud comprises the first extension, the second extension, and a shroud body and wherein a surface, which is coupled with the blade, of a portion at which the shroud body and first extension are connected to each other is curved.

9. The turbofan of claim 1, wherein a surface, which is coupled with the blade, of a portion at which the shroud body and first extension are connected to each other is concave.

10. A mold for fabricating a turbofan comprising: a hub coupled with a rotational shaft of a driving device; a plurality of blades installed at a circumference of the hub radially; and a shroud at an opposite side to the hub so as to be coupled with a plurality of the blades wherein the blades are placed between the shroud and the hub, and wherein the hub, blades, and shroud are formed in one body and wherein the shroud comprises a first extension protruding to extend from a coupling part with a leading edge at the uppermost portion of each of the blades in an inward radial direction of the rotational shaft and a second extension extending straightly from the first extension in a direction of the rotational axis toward a side opposite to the hub, assuming that a surface where the blades are formed is an upper surface by taking the hub as a reference, the mold for fabricating the turbofan, comprising:

a lower mold pattern comprising:

a hub molding part for molding a lower surface of the hub;

a blade molding part protruding upward from a circumferential end of the hub molding part in a direction of the rotational shaft so as to mold a portion of each of the blades; and a shroud molding part for molding a lower surface of the shroud having the first extension at an upper area of the blade molding part; and an upper molding pattern comprising:

a hub molding part detachable from the upper mold pattern for molding an upper surface of the hub;

a blade molding part having a boundary surface forming a boundary with an inner side of the blade molding part of the upper mold pattern for molding a remaining portion of each of the blades; and a shroud molding part for molding an upper surface of the shroud having the second extension.

11. The combination of a turbofan comprising: a hub coupled with a rotational shaft of a driving device; a plurality of blades installed at a circumference of the hub radially; and a shroud at an opposite side to the hub so as to be coupled with a plurality of the blades wherein the blades are placed between the shroud and the hub, and wherein the hub, blades, and shroud are formed in one body and wherein the shroud comprises a first extension protruding to extend from a coupling part with a leading edge at the uppermost portion of each of the blades in an inward radial direction of the rotational shaft and a second extension extending straightly from the first extension in a direction of the rotational axis toward a side opposite to the hub, assuming that a surface where the blades are formed is an upper surface by taking the hub as a reference, and a mold for fabricating the turbofan, comprising:

a lower mold pattern comprising:

a hub molding part for molding a lower surface of the hub;

a blade molding part protruding upward from a circumferential end of the hub molding part in a direction of the rotational shaft so as to mold a portion of each of the blades; and a shroud molding part for molding a lower surface of the shroud having the first extension at an upper area of the blade molding part; and an upper molding pattern comprising:

a hub molding part detachable from the upper mold pattern for molding an upper surface of the hub;

a blade molding part having a boundary surface forming a boundary with an inner side of the blade molding part of the upper mold pattern for molding a remaining portion of each of the blades; and a shroud molding part for molding an upper surface of the shroud having the second extension.

* * * * *